US006279662B1

(12) United States Patent
Sonnier

(10) Patent No.: US 6,279,662 B1
(45) Date of Patent: Aug. 28, 2001

(54) PIPE RUNNING SYSTEM AND METHOD

(75) Inventor: Errol A. Sonnier, Broussard, LA (US)

(73) Assignee: Carlos A. Torres, Houston, TX (US)

( * ) Notice: Subject to any disclaimer, the term of this patent is extended or adjusted under 35 U.S.C. 154(b) by 0 days.

(21) Appl. No.: 09/265,318

(22) Filed: Mar. 9, 1999

Related U.S. Application Data

(60) Provisional application No. 60/079,276, filed on Mar. 25, 1998.

(51) Int. Cl.[7] ..... E21B 19/06

(52) U.S. Cl. ..... 166/380; 166/77.52; 294/90; 294/102.2

(58) Field of Search ..... 294/86.1, 86.12, 294/90, 91, 102.1, 102.2, 902; 166/242.1, 242.2, 380, 77.51, 77.52; 188/67; 285/114–116

(56) References Cited

U.S. PATENT DOCUMENTS

| | | | | |
|---|---|---|---|---|
| 471,896 | * | 3/1892 | Richards | 294/91 |
| 1,385,435 | * | 7/1921 | Dunn | 294/91 |
| 1,421,266 | * | 6/1922 | Loman et al. | 294/86.12 |
| 1,601,369 | * | 9/1926 | Montgomery | 294/102.2 |
| 1,612,833 | * | 1/1927 | Pringle | 294/90 |
| 1,637,270 | * | 7/1927 | Neely | 294/102.2 X |
| 1,660,708 | * | 2/1928 | Grant | 294/102.2 |
| 3,358,341 | | 12/1967 | Burstall . | |
| 4,410,210 | | 10/1983 | de Sivry et al. . | |
| 4,725,088 | * | 2/1988 | Mank | 294/90 |
| 4,823,919 | | 4/1989 | Hayatdavoudi . | |
| 4,834,441 | * | 5/1989 | Schivley | 294/90 |
| 4,981,316 | | 1/1991 | McMahon . | |
| 5,036,927 | * | 8/1991 | Willis | 294/102.2 X |
| 5,221,099 | | 6/1993 | Jansch . | |

FOREIGN PATENT DOCUMENTS

| | | | | |
|---|---|---|---|---|
| 531672 | * | 1/1941 | (GB) | 294/102.2 |

* cited by examiner

*Primary Examiner*—Johnny D. Cherry
(74) *Attorney, Agent, or Firm*—Browning Bushman P.C.

(57) ABSTRACT

A conventional center-latch elevator with smooth slip segments of the present invention is employed to grip and suspend a pipe without damaging the pipe surface. The slip segments are made of aluminum or another material that is softer than the material of the pipe. The elimination of rough surfaces on the slip segments prevents damage to the external pipe surface. A threaded lift connector is secured to the box end of the pipe to be lifted. The lift connector forces spring-loaded slip segments down into the conical bowl of the elevator to move the segments radially inwardly into gripping engagement with the pipe. The axial forces exerted by the elevator against the bottom of the lift connector are transmitted through the connector to the threads engaged in the pipe. The arrangement prevents the forces of the elevator from being transmitted to the base of the coupling connected to the pipe to prevent coupling damage or disengagement of the coupling from the threaded pipe end. The lift connector may be employed with a coupling-type elevator that closely surrounds the pipe and engages the bottom of the lift connector when the elevator is raised to raise the pipe.

10 Claims, 4 Drawing Sheets

PIPE RUNNING SYSTEM AND METHOD

Related Applications

This application is based on provisional Application Ser. No. 60/079,276, filed on Mar. 25, 1998.

BACKGROUND OF THE INVENTION

Coupling-engaging elevators, without slips, have been employed to closely surround the pipe and engage the bottom of the coupling at the pipe end. Lifting the elevator lifts the pipe by exerting force against the base of the coupling. This technique is not suitable for use with heavy strings and couplings that are tapered, slender, or otherwise incapable of withstanding the concentrated axial forces imposed along their lower perimeter. Conventionally, heavy strings and pipe with connections not suitable for use with a coupling-engaging elevator have required the use of slip-type elevators. The slip-type elevators are equipped with dies having teeth designed to increase the frictional resistance between the elevator and the pipe. These teeth exert an increasingly greater radial force against the pipe as the weight of the string increases. Pipe made from certain alloys, including chrome, and nickel and steel, is easily damaged by the effects of the die teeth. Such materials are typically required in highly corrosive environments in which any pipe damage is particularly hazardous.

SUMMARY OF THE INVENTION

A conventional, slip-type elevator is equipped with smooth surface pipe-gripping elements to prevent damage to the pipe surface. The contact elements are made of a material that is softer than that of the pipe. The resultant radial forces between the pipe-gripping elements and the pipe force the softer material of the gripping elements to be slightly deformed into the small irregular surface areas on the external surface of the pipe to increase the frictional gripping force. In one form of the invention, a lift connector is also provided to increase the radial forces acting through the pipe-gripping elements. The lift connector is threadedly engaged with the threaded end of the pipe string and is provided with a sleeve that extends over the threaded end of the pipe and down to the pipe-gripping elements. The axial force exerted by engagement of the lift connector with the pipe-gripping elements is transmitted through the lift connector to the connected threads between the lift connector and the pipe. The lift connector thus prevents the forces supporting the pipe from being concentrated at the base of the coupling, as occurs with non-slip lifting elevators.

Non-slip-type lifting elevators may also be employed with the lift connector of the present invention whereby the sleeve of the lift connector engages the elevator and transmits the elevator lifting force to the connected threads between the connector and pipe. The threaded engagement between the connector and pipe has strength equivalent to that of a conventional threaded connection in the pipe string, and the forces imposed by the lift connector are uniformly distributed through the threaded connection as they would be in a normal connection. The lift connector thus prevents the application of concentrated lifting forces at the base of the pipe coupling to prevent damage to the coupling base and to prevent the possibility of the coupling's separating from the threaded section of the pipe.

In the slip-type elevator of the present invention, spring-loaded slip assemblies are employed to provide a smooth surface contact with the pipe to be engaged and held. The contact or gripping portion of the slip assembly is formed of a material that is softer than the pipe that is to be engaged. The gripping material may, for example, be aluminum when used with steel pipe. Conventional, spring-loaded steel slip segments may be equipped with aluminum dies or facings having smooth pipe contact surfaces to provide a slip assembly in which the pipe-engaging components are softer than the steel material of the pipe. In another form of the invention, the entire slip assembly may be formed as a single body made completely of a softer material, such as aluminum, to provide the desired gripping, non-damaging contact with the engaged pipe.

In the system of the invention, the lift connector and spring-loaded pipe-engaging elements are employed in combination to ensure that the pipe will not slip from the elevator. If the pipe-gripping elements engage the pipe where the elevator is latched (closed), the relative axial movement between the spring-loaded slip segments and the pipe will cause the slip-gripping elements to hold and grip the pipe to prevent additional axial pipe movement. In the event the gripping force is not strong enough, the pipe will move down through the elevator until the lift connector engages and rests on the top of the pipe-engaging assembly, thereby increasing the radial gripping force and stopping the downward pipe movement.

In the method of the invention, a lift connector is threaded to the top of a joint of pipe, and the joint of pipe is made up into the pipe string. The elevator is then engaged about the tubing, below the coupling. Where the gripping elements do not initially engage the tubing, the elevator is raised until the lift connector engages the spring-loaded pipe-gripping elements of the elevator and forces them radially into engagement with the pipe. Subsequently, the additional pulling force is supported by the elevator through the pipe-gripping elements primarily, rather than through the lift connector, thereby minimizing the forces acting through the threaded connection between the lift connector and the pipe while maintaining the pipe firmly within the elevator-gripping elements.

DESCRIPTION OF THE EMBODIMENTS

Figure 1:
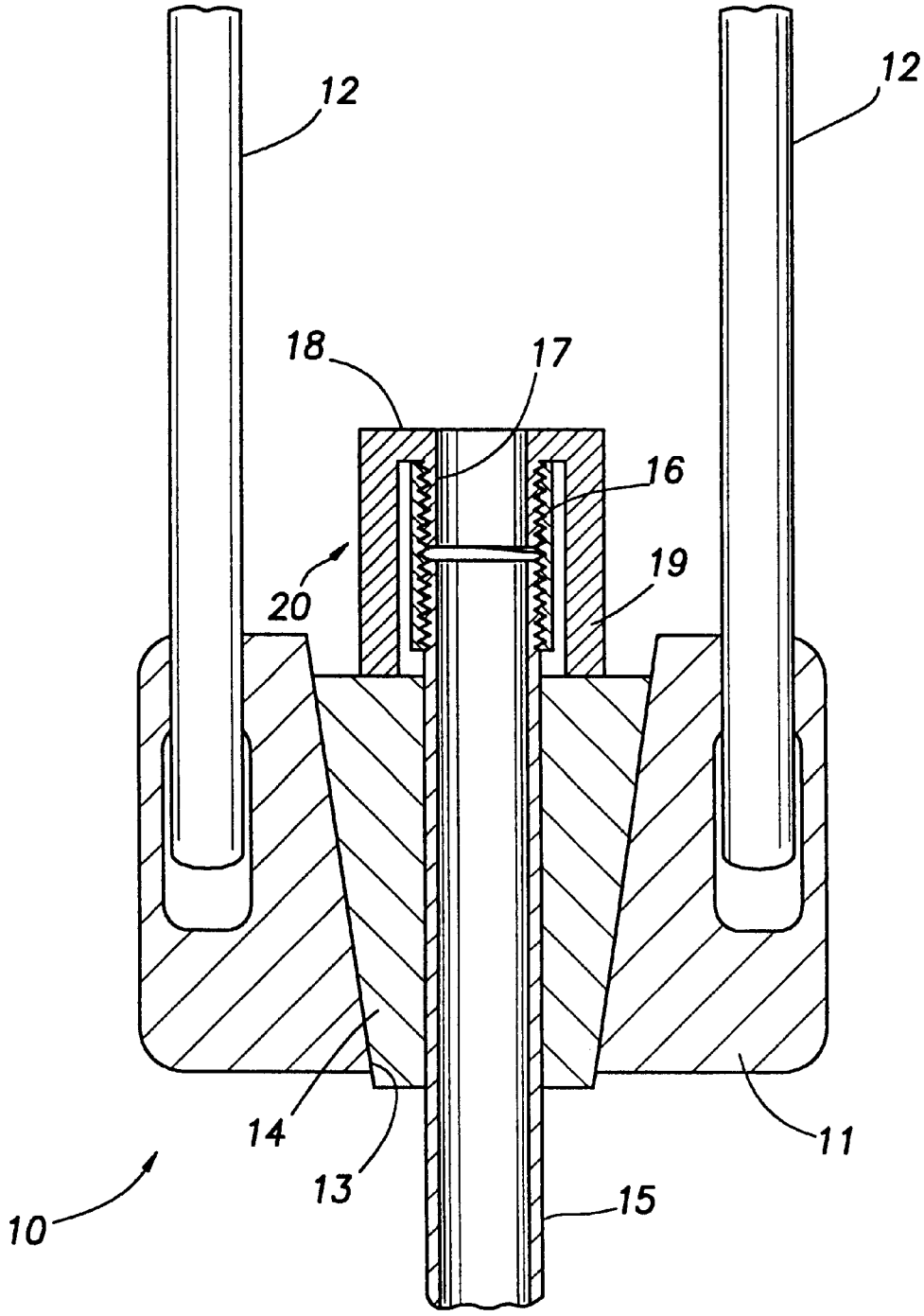
FIG. 1 is a vertical elevation, partially in section, illustrating an elevator of the present invention equipped with the lift connector and smooth pipe-gripping elements of the present invention.

FIG. 1 illustrates the system of the present invention generally at 10 and includes an elevator 11 supported by two bales 12. The elevator 11 has a conical bowl 13 that carries multiple wedge-shaped pipe-gripping elements 14. In a preferred form, four similar elements are employed in a single bowl. The pipe-gripping elements are shown engaged about a pipe section 15 extending axially through the center of the pipe-running system 10.

The upper end of the pipe 15 is provided with a coupling 16 that is threadedly engaged with the upper threaded end of the pipe. The internally threaded area at the top end of the coupling 16 forms the "box" for the pipe section 15. As well known in the art, the box may also be formed as an integral, internally threaded area of the pipe section 15. An externally threaded pin 17 is threadedly engaged with the internal threads of the threaded box formed at the upper end of the coupling 16. The pin 17 is connected by a connecting structure 18 with a vertically depending sleeve 19 that extends over the coupling 16 to a point below the bottom end of the coupling. The pin 17, connecting structure 18, and sleeve 19 form a lift connector 20 that is employed to transmit axial forces exerted at the base of the sleeve 19 to the threaded engagement between the pin 17 and the box of the pipe section 15. This pin and box connection is equivalent to the threaded connection of other pin and box connections in a conventional coupling connection within the pipe string such as the connection indicated generally at C in FIG. 4.

In operation, as the elevator bales 12 are lifted by the traveling block (not illustrated), the slip segments 14 drag along the external surface of the pipe 15 and, if sufficient frictional forces are induced, the elements 14 are moved axially downwardly through the elevator bowl 13, causing the elements to move in radially and grip the pipe. Increased forces cause the axial downward force to increase, which in turn increases the radial forces acting through the combined effect of the tapered elements 14 and the conical bowl 13. If the pipe-gripping elements 14 begin to slip over the pipe 15, the lift connector 20 is moved into engagement with the top of the pipe-gripping elements 14, forcing them downwardly, which in turn increases the radial gripping force of the elements. This action distributes the load between the pipe-gripping elements 14 and the threaded pin connection 17 in the lift connector. The result is a lessened load at the connection of the lift connector. Continued slippage of the pipe is also prevented by the engagement of the lift connector 20 with the pipe-gripping elements 14.

Figure 2:
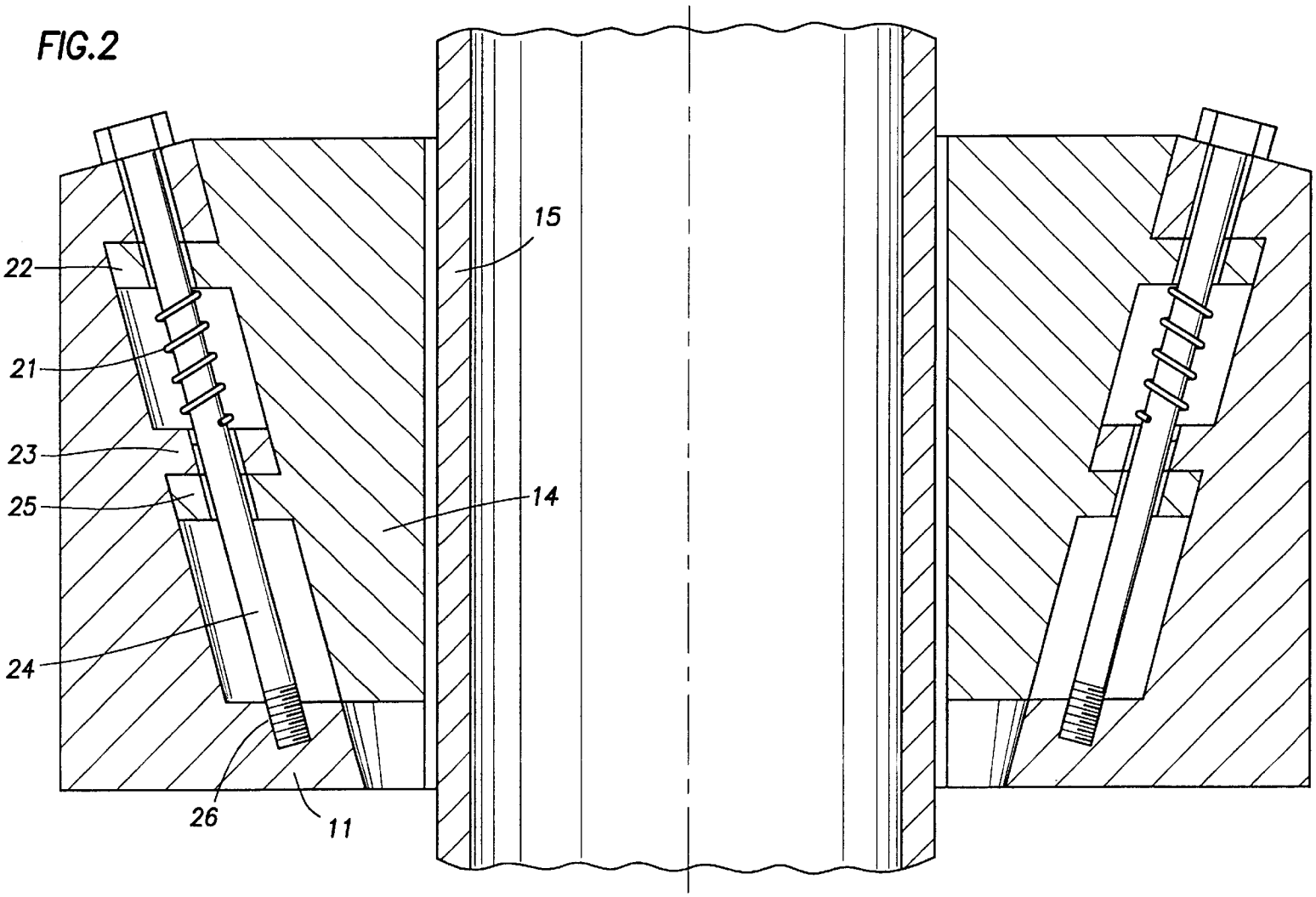
FIG. 2 is a vertical quarter section elevation illustrating details in a spring-loaded pipe-gripping element of the present invention.

FIG. 2 illustrates details in a conventional center latched slip-type elevator equipped with the pipe-gripping elements of the present invention. In a conventional slip grip elevator, such as the type YC, YT, MYT, and LYT elevators manufactured by B. J. Hughes and their predecessors, the elevator opens up to permit the pipe to be received within the center of the elevator. The elevator is closed, and the pipe-gripping elements carried by the elevator are brought into close contact with the pipe body. The pipe-gripping elements are constantly urged upwardly and radially away from the pipe by a coil spring supporting each of the four elements. If the gripping elements engage the pipe surface, upward movement of the elevator pulls the segments down into the conical bowl of the elevators, forcing the pipe-gripping elements into tighter radial gripping engagement with the pipe.

The elevator of the present invention may be made by replacing the steel, toothed die insert of the BJ-type elevator with smooth face (tooth-free) aluminum inserts of similar shape and dimension. Additionally, the steel die may be replaced with a larger aluminum die that provides a substantially continuous pipe contact area over the radially inner pipe contact surface of the slip. Such a slip is provided with a specially configured retaining slot that holds the back of the larger die. If desired, the insert slots of the BJ slip may serve as retaining slots for integral supports on the back of the larger aluminum die. The supports of such a die may have the profile and dimension of the steel die insert normally held in the slots.

FIG. 2 illustrates a spring 21 extending between an upper pipe-gripping ear 22 and a lower bowl extension ear 23. A keeper pin 24 extends through the elevator body 11, through the gripping element ear 22 and bowl extension ear 23 into a second gripping element ear 25. The base of the keeper pin 24 is threadedly engaged at 26 in the body of the elevator 11. As may be observed in FIG. 2, the pipe-gripping element 14 is biased upwardly by the engagement of the coil spring 21. The upward bias of the gripping element maintains the element radially away from the pipe 15 and at the upper extreme of the elements' movement so that subsequent downward movement of the element will be allowed to provide the required radial closing movement to grip the pipe.

In operation, the segment 14 maybe dimensioned to contact the external surface of the pipe 15 when the elevator 11 is closed. In such an arrangement, the downward movement of the pipe may be sufficient to pull the element 14 downwardly, causing it to grip the wall of the pipe. If such frictional engagement is not initially present or the force is not sufficient to provide the initial gripping force, the engagement of the lift connector 20 with the top of the segment 14, as previously described, forces the segment 14 radially inwardly against the pipe to increase the gripping force.

Figure 3:
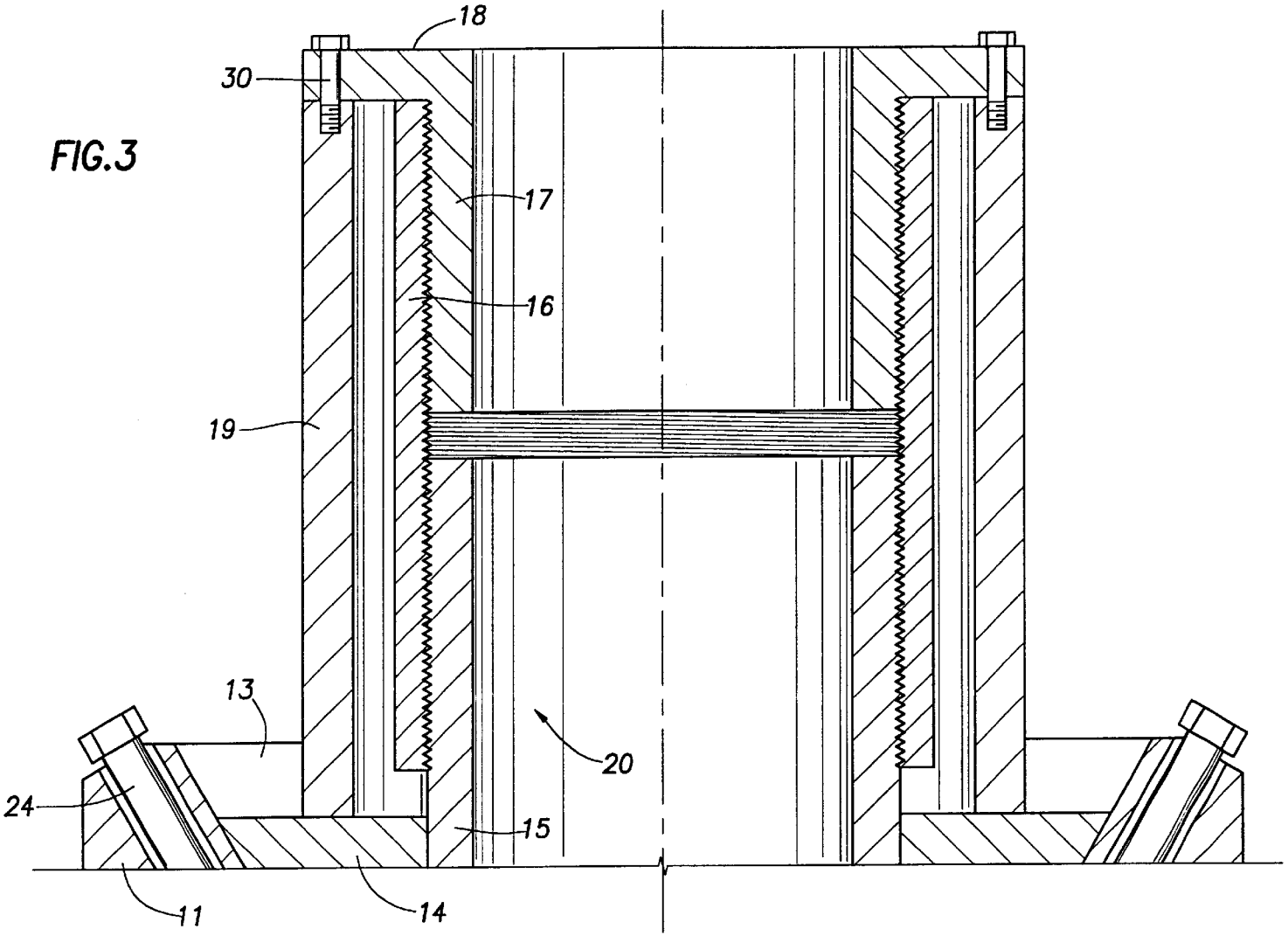
FIG. 3 is a vertical quarter-section elevation illustrating details in the construction of the lift connector of the present invention.

FIG. 3 illustrates details in the construction of the lift connector 20. The threaded pin section 17 may be integrally formed with the connecting structure 18 or may be welded or otherwise secured to the structure. The sleeve 19 is preferably connected to the structural member 18 by bolts 30 or other suitable means. Providing the sleeve 19 as a separate component of the structural member 18 and threaded pin 17 facilitates the formation of the threaded surface on the pin 17. The length of the sleeve 19 is such that when the desired optimum thread engagement between the pin 17 and the coupling 16 has been secured, the bottom of the sleeve will depend below the bottom of the coupling to prevent engagement of the coupling end with the pipe-gripping element 14. By this means, it will be appreciated that the axial forces directed against the lift connector 20 by the elevator 11 are transmitted through the sleeve 19 and connecting structure 18 to the threaded engagement of the pin 17 and coupling 16. The support force acting through the coupling is less than that normally encountered in the conventional coupling engagement between adjoining joints in a string because part of the pipe weight is supported by the pipe-gripping elements 14. This feature and the additional positive interference of the structure of the lift connector and the opening through the elevator 11 combine to prevent slippage and dropping of the pipe suspended by the elevator.

Figure 4:
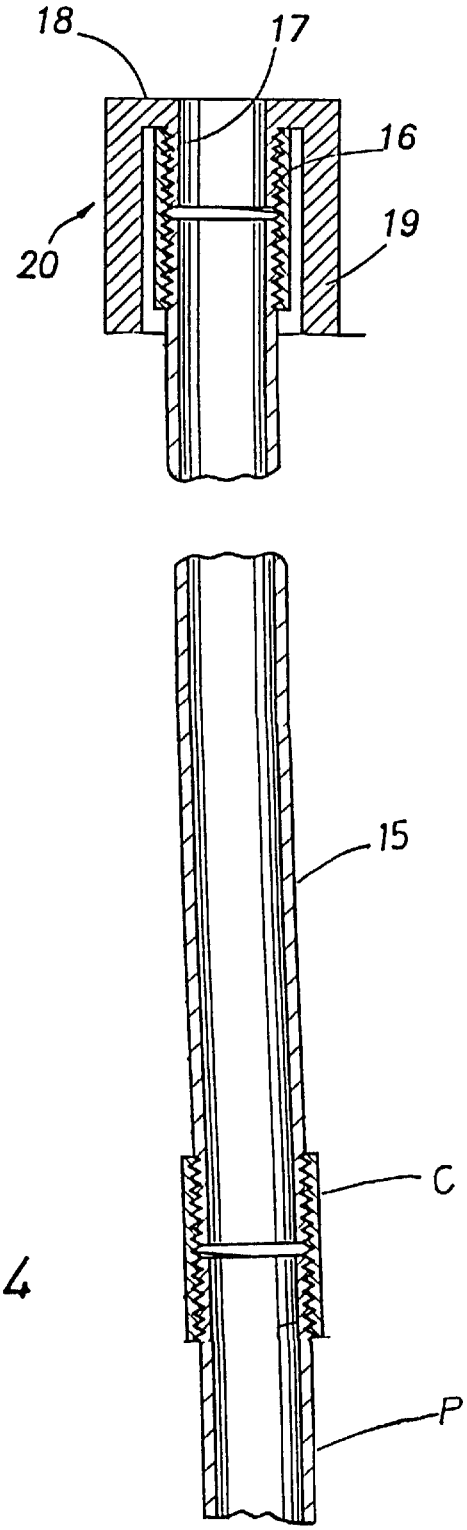
FIG. 4 is a vertical elevation, partially in section, illustrating a method of the present invention adding a pipe section to a pipe string.

With joint reference to FIGS. 1 and 4, in the method of the invention, a lift connector 20 is threaded to the top of a pipe section or "joint" of pipe 15, and the joint of pipe is made up into the pipe string P. The elevator is then engaged about the pipe section 15, below the coupling 16. Where the gripping elements 14 do not initially engage the pipe section 15, the elevator 11 is raised until the lift connector engages the spring-loaded pipe-gripping elements of the elevator and forces them radially into engagement with the pipe. Subsequently, the additional pulling force is supported by the elevator through the pipe-gripping elements 14 primarily, rather than through the lift connector 20, thereby minimizing the forces acting through the threaded connection between the lift connector and the pipe while maintaining the pipe firmly within the elevator-gripping elements.

What is claimed is:

1. A method of running pipe in a well comprising the steps of:

attaching a pin of a lift connector to a threaded box of a pipe section, said lift connector having a sleeve coaxially disposed with the box of the pipe section and extending from the box of the pipe section in a direction toward a pin of the pipe section;

attaching an elevator about the pipe section between the pin and box of said pipe section;

engaging the pin of the pipe section with the box of a pipe string extending from the well;

raising the elevator to engage the lift connector sleeve; and lifting the pipe section and pipe string by raising the elevator.

2. A method as defined in claim 1 further comprising moving a plurality of tapered pipe-gripping elements in said elevator axially with said sleeve as said elevator is raised to move said pipe-gripping elements radially into engagement with the pipe section.

3. A method as defined in claim 2 further comprising providing said pipe-gripping elements with substantially smooth internal surfaces for engaging the pipe section.

4. A method as defined in claim 2 further comprising providing pipe-gripping elements constructed of a material that is softer than the material of the pipe.

5. A method as defined in claim 2 further comprising providing pipe-gripping elements constructed of an aluminum alloy.

6. A method as defined in claim 2 further comprising biasing said pipe-gripping elements radially away from said pipe section.

7. A method as defined in claim 2 further comprising carrying the pipe section and string by the lift connector and the pipe-gripping elements.

8. A method as defined in claim 1 further comprising extending said sleeve axially beyond the box of the pipe section when the lift connector pin is engaged in the box of the pipe section.

9. A method as defined in claim 1 further comprising removably securing said sleeve to said pin of said lift connector.

10. A method as defined in claim 9 further comprising removably securing said sleeve to said lift connector by bolts.

* * * * *